United States Patent [19]

Seplin

[11] 4,289,413

[45] Sep. 15, 1981

[54] CARTRIDGE AND RIBBON FOR USE WITH A SINGLE SPOOL STENOTYPE MACHINE

[76] Inventor: Stanley Seplin, 720 Rivergate Plz., Miami, Fla. 31331

[21] Appl. No.: 4,730

[22] Filed: Jan. 19, 1979

[51] Int. Cl.[3] ..... B41J 33/10

[52] U.S. Cl. ..... 400/196; 400/202.4

[58] Field of Search ..... 400/91, 92, 93, 94, 400/194, 195, 196, 202 A, 192, 208; 192/41 R

[56] References Cited

U.S. PATENT DOCUMENTS

| | | | |
|---|---|---|---|
| 2,102,693 | 12/1937 | Garbell | 400/194 |
| 2,319,273 | 5/1943 | Sterling | 400/194 X |
| 2,387,330 | 10/1945 | Johnson et al. | 400/194 X |
| 2,392,078 | 1/1946 | Wright | 400/93 |
| 2,393,781 | 1/1946 | Johnson et al. | 192/41 R |
| 2,508,780 | 5/1950 | Von Duyke | 400/194 |
| 2,755,905 | 7/1956 | Segui | 400/196 |
| 2,904,157 | 9/1959 | Smith | 400/194 X |
| 3,490,671 | 1/1970 | Hladky | 400/196 X |
| 3,643,779 | 2/1972 | Anderson et al. | 400/196 |
| 3,887,056 | 6/1975 | Lehmann | 400/202.4 X |
| 3,904,018 | 9/1975 | Denley | 400/202.4 X |
| 3,918,569 | 11/1975 | Parker | 400/196 |
| 3,993,182 | 11/1976 | Steinke | 400/195 |
| 3,995,731 | 12/1976 | Miller et al. | 400/195 |
| 4,019,617 | 4/1977 | Englund et al. | 400/192 X |

FOREIGN PATENT DOCUMENTS

| | | | |
|---|---|---|---|
| 2517824 | 11/1975 | Fed. Rep. of Germany | 400/196 |

OTHER PUBLICATIONS

IBM Technical Disclosure Bulletin, "Magnetic Tape Cartridge", Barnard et al., vol. 7, No. 12, May 1965, p. 1142.

Xerox Disclosure Journal, "Ribbon Feed Rolls", Plaza, vol. 1, No. 2, Feb. 1976, pp. 43–44.

*Primary Examiner*—Ernest T. Wright, Jr.

*Attorney, Agent, or Firm*—John Cyril Malloy

[57] ABSTRACT

For use with a single spool stenotype machine having keys connected to an array of character members in a group adjacent an impression plane, a sealed cartridge and ribbon length which includes guide tracks to guide a ribbon from a spool rotatable in the cartridge past the impression plane and which spool is adapted to turn to move the ribbon past the impression plane and through the guide tracks.

3 Claims, 4 Drawing Figures

CARTRIDGE AND RIBBON FOR USE WITH A SINGLE SPOOL STENOTYPE MACHINE

FIELD OF THE INVENTION:

This invention relates to a cartridge and a ribbon together with a means to ink the ribbon for use in stenographic machines and, quite often by Court Reporters in transcribing dictation.

BACKGROUND OF THE INVENTION:

In the past there has been a substantial problem often encountered by persons recording stenographically the proceedings before a Court or administrative body. It is important that there not be interruptions in such proceedings; however, mechanical limitations have been typical of such machines used by reporters. One of the problems has been that the machine quite often runs out of tape or ribbon or, alternatively, the ribbon must be re-inked which is a messy job. The instant invention provides a cartridge which is adapted to be inserted into a stenographic machine as a unit in a clean, simple and swift operation, thus avoiding interruptions of any substantial length of time in the recording process and wherein the cartridge includes an ink pad which is annular in shape and which is carried on a spool and may be inked conveniently in a very short period of time as will be apparent from the structure described hereinafter. There have been numerous types of ribbon feeding devices, including the following of which U.S. Pat. No. 2,755,905 is for a shorthand typewriter, as is U.S. Pat. No. 2,904,157. A ribbon feeding mechanism is illustrated in U.S. Pat. No. 3,490,671. U.S. Pat. No. 3,643,779 is of a ribbon mechanism for for cartridge supported ribbons. An endless printer ribbon cartridge apparatus is disclosed in U.S. Pat. No. 3,918,569 and similarly in No. 3,993,182. A multi ribbon cassette and ribbon drive is disclosed in U.S. Pat. No. 3,995,731. Also, a printing device having a printing station and drive means for a roller system is found in U.S. Pat. No. 4,019,617.

OBJECTS OF THE INSTANT INVENTION:

Generally speaking, it is an object of this invention to provide an improved cartridge which includes a rotatable spool with an annular ink pad mounted upon it and a guide track means to constrain a ribbon to passage through a predetermined path of movement for use in a stenotype machine and which ink pad may be inked conveniently and wherein the cartridge is adapted to mate with the existing apparatus and the operating parts of a stenographic machine into which it may be rapidly installed. It includes guide means to facilitate passage of a ribbon in a continuous loop which includes at one side a spool driven by the machine and a portion of which continually passes the impression plane of the keys of the machine.

In accordance with these and other objects which will become apparent hereinafter, the instant invention will now be described with reference to the accompanying drawing in which:

Figure 1:
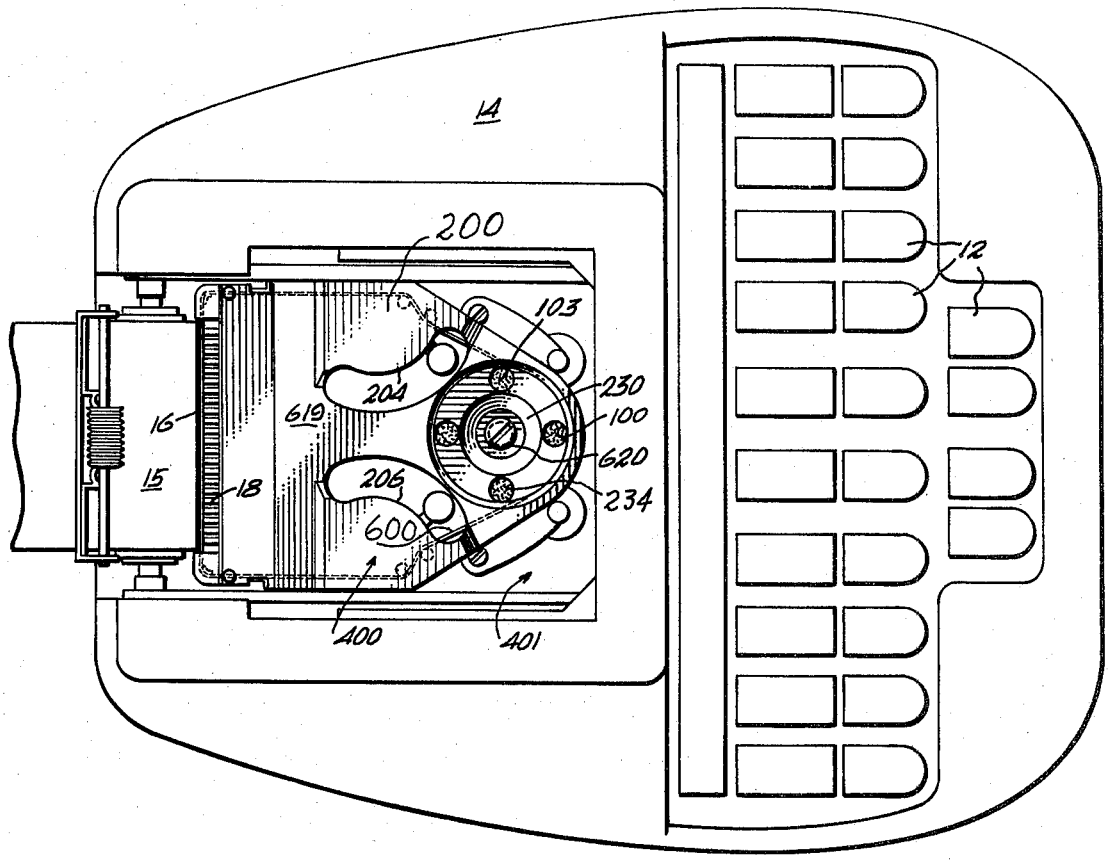
FIG. 1 is a top plan view of a conventional Stenograph machine.

DESCRIPTION OF THE PREFERRED EMBODIMENT:

Referring to the drawing, the numeral 14 designates a coventional stenotype machine, widely used and sold commercially under the trademark Stenograph which is manufactured and sold by Stenographic Machines, Inc. of Skokie, Ill. under various patent numbers, such as U.S. Pat. Nos. 2,319,273; 2,387,330; 2,392,078; and 2,393,781. The machine is provided with a bank of keys 12 which are manipulated by an operator and which are operatively connected to an array 18 of characters to forceably and selectively move them to impact on a confronting surface of a horizontally arranged roll of paper 15 at a printing station or an impression plane 16. As the keys 12 are operated, a ribbon 600 moves past the impression plane or printing station 16 between the array 18 of characters and the roll of paper 15 to cause a series of character impressions on the roll of paper 15. Also, as is conventional, the machine 14 includes a recess 401 in the top surface into which the cartridge 400, see FIG. 4, is adapted to be inserted, as shown in FIG. 1, the cartridge 400 being sized to nest within the recess 401 in a preferred embodiment, as illuatrated.

The stenographic machine 14 does not constitute this invention; however, as is well known, within the aforementioned recess 401 provided in the upper surface of such machines conventionally, a replaceable ribbon spool 234 is positioned over an upstanding spindle, the head of which is designated by the numeral 620 in FIG. 1. Such spools 234 have a downwardly facing annular gear 22 the gear surfaces being designated in FIG. 4 by the numeral 24. This gear 22 is in driving engagement with a gear of the machine which is designated by the numeral 20 and shown in dotted lines in FIG. 4. This gear 20 turns as the keys 12 are operated which turns the ribbon spool 234.

Figure 2:
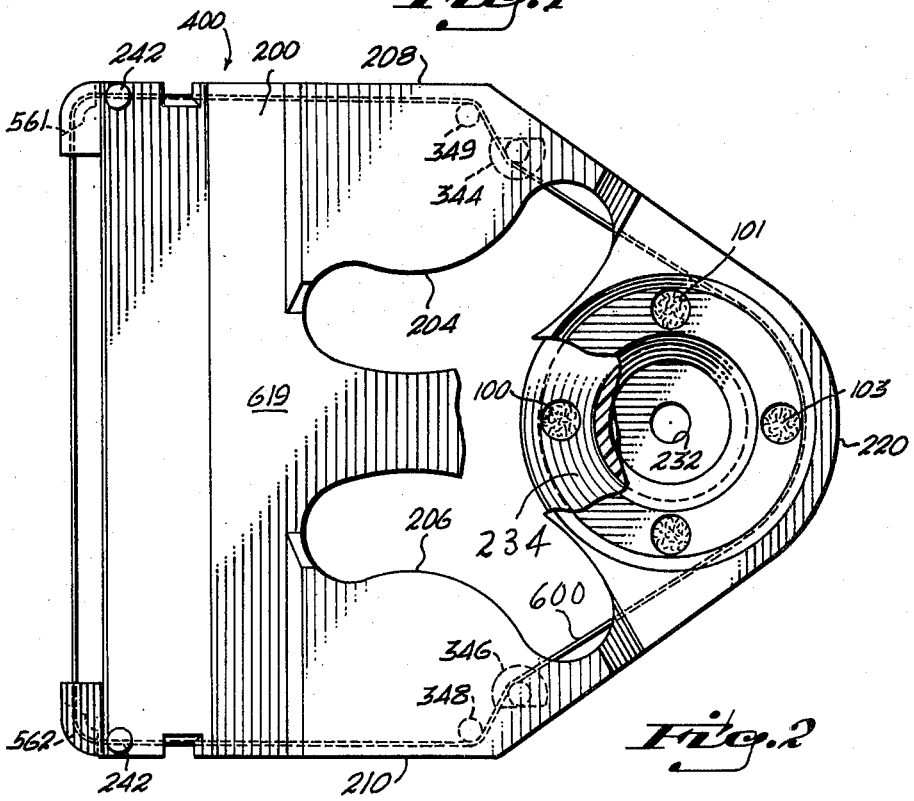
FIG. 2 is a top plan view of the instant ribbon cartridge invention, the same having been partially broken away to illustrate the same.
Figure 3:
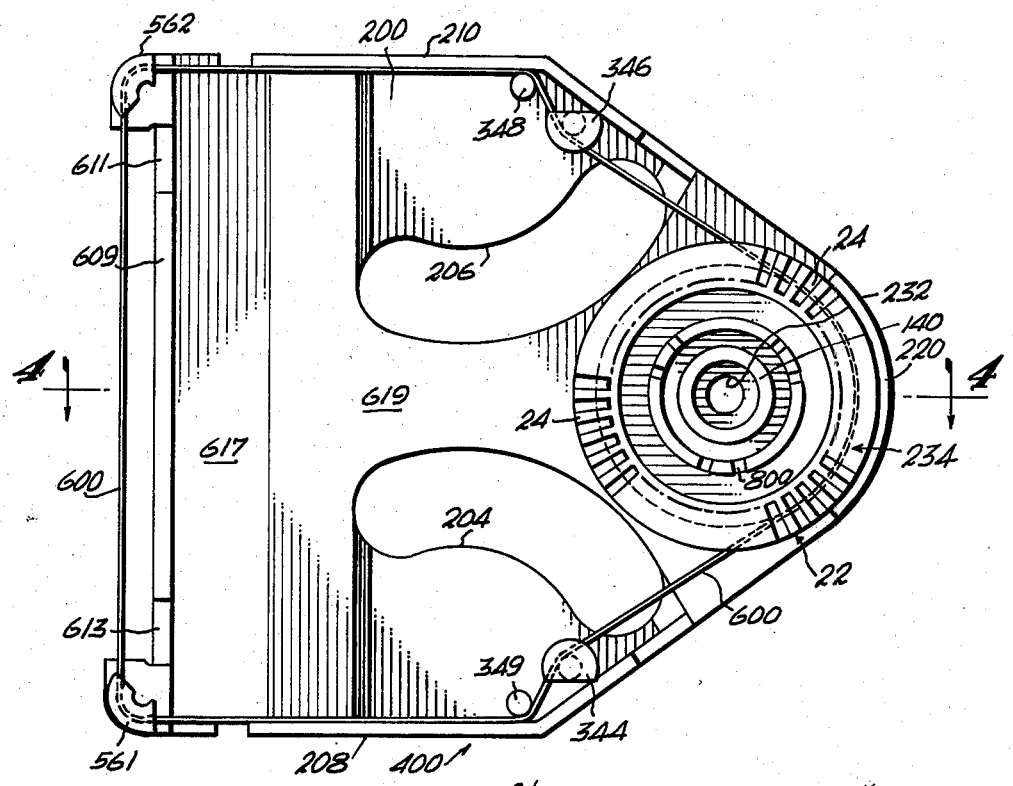
FIG. 3 is a bottom plan view of the device shown in FIG. 2.
Figure 4:
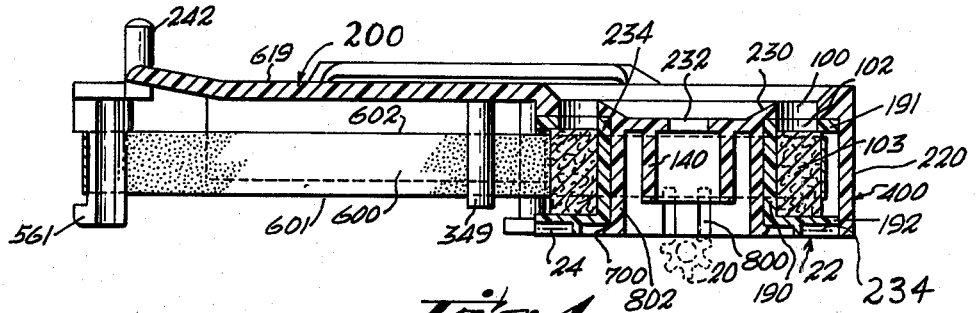
FIG. 4 is a view in cross section taken on the plane indicated by the line 4—4 of FIG. 3 and looking in the direction of the arrows.

The instant invention comprises, generally, a ribbon cartridge 400 see FIGS. 2, 3, and 4 composed of a tray or support 200 with a main surface or roof 619 with guide means for the ribbon 600, the lower edge 601 of which is adjacent the guide means and the upper surface 602 of which is closely adjacent the tray roof 619; the guide means includes a spool 234 comprising a rotatable ink pad 103 and over which the ribbon 600 is constrained to pass in operation.

Referring more in detail to the drawing, and particularly to FIG. 4, it is seen that the spool 234 is journaled to the tray 200 being supported in depending relation on an annular foot 700 of the depending annular skirt 802. The tray roof 619 has an annular through opening 232 which accommodates an upstanding spindle on which it is captivated rotatably by the screw head 620 of the spindle which is seen in FIG. 1. An annular hub structure 140 extends downwardly from the zone 230 of the roof 619 which overlays or covers the spool 234 and this zone 230 which has a plurality of openings, such as that designated by the numeral 100 in FIG. 1 and FIG. 4, for example. The hub structure 140 is concentric with the downwardly extending annular skirt 802 and is within that skirt 802. The skirt 802, at its lower terminal end, is footed so as to provide a spool support, foot, or annular ledge 700. It will be seen that the structure thus described defines an annular recess which supports the spool 234 beneath the top zone 230 for rotatable movement on the skirt 802. The spool 234 has an inside cylindrical wall 190 and an upper and lower wall 191 and 192. These walls 190, 191 and 192 are sized and configured to nest in the annular recess defined by the skirt 802, foot 700 and the roof zone 230. The spool 234 is rotatable with respect to the skirt 802 when the gear 20 engages gear 22, having gear surfaces 24. It is thus seen that, when the gears 20 and 22 turn, the spool 234 will will also turn. Carried on the spool 234 is an annular ink pad 103. Through the holes 102 in the top or upper wall 191 of the spool 234, the same may be inked when the holes 100 and 102 are in registry. Preferably, the roof zone 230 is slightly recessed as shown.

Extending outwardly and rearwardly from the roof zone 230 over the spool 234, the roof 619 provides an upper shield in which there are arcuate clearance slots 204 and 206 and wherein the terminal margin 617 is sized to extend sufficiently outwardly to a terminal end lip 609 which has side cutouts 611 and 613 for mating and positioning of the cartridge 400.

Referring to FIG. 3, it is seen that, when inverted, there is a ribbon guide path for the ribbon 600 which includes the guide pins 344 and 346 and 348 and 349 as well as the outer guides 561 and 562. Thus, when a spool 234 is on the tray 200 and a ribbon 600 is taut about the guide means described previously, its surface will be in contact with the ink pad 103 and, when the ink pad 103 turns, that is, when the gear 20 moves, the ribbon 600 will progressively move past the impression plane 16. For inserting and removing the device, lift pins 242, see FIG. 4, are preferably provided. The guide means 561 and 562 are preferably footed as at 561' in FIG. 4 for mating engagement with a recess in the machine 14, as are the lower ends of the pins 348 and 349. Additionally, a shield 220, see FIG. 4, in the form of a partial skirt extends downwardly and is arcuate as shown at the right of FIG. 4 to permit ease of handling of the cartridge 400 without getting ink on one's finger. Also, side skirts 208 and 210 are provided for the same purpose. In use, ink may be inserted or applied to the pad 103 by dropping drops of ink through the hole 100 with peripheral wall 101 and hole 102 when holes 100 and 102 are in registry. It is thus seen that a device has been provided whereby the ribbon 600 is continuously inked. The device may be of molded rigid plastic material in a preferred embodiment. In a preferred embodiment and as seen in the bottom view as well as in FIGS. 3 and 4, the skirt 802 may be relieved as by cutouts, see 800.

What is claimed is:

1. For use in combination with a stenograph machine having a recess of predetermined size and configuration opening upwardly and including a drive gear extending into the recess, said recess as seen in plan defining an impact plane in said recess, a ribbon cartridge having a front and rear and said cartridge being sized and configured to be received in the recess with said front at said plane, said cartridge comprising a generally horizontally disposed shield, said shield including a downwardly extending annular skirt having a lower outturned distal end spaced from said shield a predetermined distance, a spool of an axial dimension less than said predetermined distance sized to be received and journaled about said skirt and supported on said lower outurned distal end, said spool including an annular ink pad rotatable with said spool and said pad having an outer surface and comprising means to soak up a supply of ink, said skirt, spool and pad being sized and arranged with said outer surface being adjacent the cartridge rear, said spool having a downwardly facing annular gear surface sized and arranged for companionate engagement with the drive gear when the cartridge is in the recess adapting the spool for rotation about the skirt when the drive gear turns;

guide means extending from the shield comprising spaced downwardly extending guide pins and defining a ribbon path about the pins and outer surface of said pad on said spool, a taut loop form ribbon disposed about said pad and in engagement with said outer surface of said pad, said ribbon having an inside surface and an outside surface and being of a width less than said predetermined distance and said inside surface being at all times in engagement with said ink pad for movement along said path when said spool is rotated and with a portion of the outside ribbon surface at all times being at said plane, said spool having an access opening means facing upwardly for charging ink through said opening means onto said pad to be soaked into said pad.

2. The device as set forth in claim 1 wherein said shield includes a depending partial skirt disposed about said spool and annular skirt at said rear.

3. The device as set forth in claim 1 or claim 2 wherein said shield, guide means, annular skirt and spool are of rigid plastic material.

* * * * *